US005846265A

United States Patent [19]

McGregor et al.

[11] Patent Number: 5,846,265

[45] Date of Patent: *Dec. 8, 1998

[54] CLOSED-LOOP TEXTILE DYEING PROCESS UTILIZING REAL-TIME METERED DOSING OF DYES AND CHEMICALS

[75] Inventors: Ralph McGregor, Raleigh; Manpreet Singh Arora, Charlotte; Warren J. Jasper, Cary, all of N.C.

[73] Assignee: North Carolina State University, Raleigh, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 687,733

[22] Filed: Jul. 26, 1996

[51] Int. Cl.[6] ..... D06P 3/06

[52] U.S. Cl. ..... 8/400; 8/502; 8/673; 8/680; 8/924

[58] Field of Search ..... 8/400, 502, 673, 8/680, 924

[56] References Cited

U.S. PATENT DOCUMENTS

| | | | |
|---|---|---|---|
| 3,932,127 | 1/1976 | D'Albignac | 8/173 |
| 3,949,575 | 4/1976 | Turner et al. | 68/5 |
| 3,966,406 | 6/1976 | Namiki et al. | 8/179 |
| 4,350,494 | 9/1982 | Scheidegger et al. | 8/636 |
| 4,483,032 | 11/1984 | Christ et al. | 8/149 |
| 4,562,604 | 1/1986 | Damm | 8/158 |
| 4,629,465 | 12/1986 | Hasler et al. | 8/400 |
| 4,737,157 | 4/1988 | von der Eltz et al. | 8/543 |
| 4,746,324 | 5/1988 | von der Eltz et al. | 8/549 |
| 4,820,312 | 4/1989 | von der Eltz | 8/533 |
| 5,114,427 | 5/1992 | Damm | 8/400 |
| 5,167,668 | 12/1992 | Hahnke et al. | 8/400 |
| 5,176,715 | 1/1993 | Horn | 8/400 |
| 5,230,709 | 7/1993 | Holfeld et al. | 8/400 |
| 5,314,504 | 5/1994 | Holfeld et al. | 8/115 |
| 5,318,598 | 6/1994 | Holfeld et al. | 8/400 |
| 5,364,417 | 11/1994 | Wenstrup et al. | 8/592 |
| 5,366,511 | 11/1994 | Holfeld et al. | 8/400 |

OTHER PUBLICATIONS

*McGregor et al.,* "Real Time Analysis and Control of Batch Dyeing Processes", National Textile Center (NTC) Annual Report, Aug. 1995, pp. 259–267.

*McGregor et al.,* "Real Time Analysis and Control of Batch Dyeing Processes", National Textile Center (NTC) Research Briefs, May 1995, pp. 16–18.

"Real–Time Data Acquisition, Theoretical Modeling, and Adaptive Control of Batch Dyeing Processes" *NTC Quarterly Report,* p. 33 (period ending Mar. 31, 1993).

"Dimensionless Groups of Variables", *National Textile Center Annual Report* pp. 263–264 (Sep. 1994).

K. Beck et al., Real–Time Data Acquisition, Theoretical Modeling and Adaptive Control of Batch Dyeing Processes *National Textile Center Quarterly Report,* pp. 21–22 (Apr.–Jun. 1993).

(List continued on next page.)

*Primary Examiner*—Margaret Einsmann
*Attorney, Agent, or Firm*—Jenkins & Wilson, P.A.

[57] ABSTRACT

A process for the dyeing of a fibrous article utilizing closed-loop metered dosing of one or more dyes and one or more chemicals that are adjusted in real time as a function of selected monitored parameters of the dyeing bath. The process includes immersing the fibrous article in a heated liquid bath of a solvent medium for the dye wherein the bath has a predetermined pH. Acid is added to the dyeing bath to reduce the pH according to a predetermined profile that is responsive to real-time measurements of dyeing bath pH. Dye is also added to the dyeing bath during dyeing as a liquid concentrate and responsive to real-time calculations of dye uptake by the fibrous article. Dye uptake is calculated periodically by determining in real time during dyeing (1) the solution concentration of the dye in the dyeing bath and (2) the amount of the dye added to the dyeing bath, and then calculating the uptake of dye by the fibrous article therefrom. The dye addition rate during dyeing is adjusted in accordance with the calculated dye uptake by the fibrous article.

51 Claims, 9 Drawing Sheets

OTHER PUBLICATIONS

Keith Beck et al., "Real–Time Data Acquisition, Theoretical Modeling and Adaptive Control of Batch Dyeing Processes", *Natinal Textile Center Quarterly Report,* pp. 10–11 (Dec. 31, 1993).

Keith Beck et al., "Real–Time Data Acquisition, Theoretical Modeling and Adaptive Control of Batch Dyeing Processes" *National Textile Center Research Briefs,* pp. 16–17 (Jun. 1994).

McGregor et al., "Real–Time Data Acquisition, Theoretical Modeling and Adaptive Control of Batch Dyeing Processing", *National Textile Center Research Briefs,* p. 17 (Dec. 1994).

Ralph McGregor et al., "Real–Time Analysis and Control of Batch Dyeing Processes", *National Textile Center Research Briefs,* p. 16 (May 1995).

K.R. Beck et al. "Wet Processing Optimization and Control", *NTC Quarterly Report,* p. 17 (period ending Sep. 30, 1992).

K.R. Beck et al. "Wet Processing Optimization and Control" *NTC Quarterly Report,* pp. 16–17 (period ending Jun. 30, 1992).

Ralph McGregor, "Pilot Scale Implementation: Real–Time Monitoring and Control of Batch Dyeing Procsses" *National Textile Center Report* p. 18 266 (Dec. 1994).

"Closed–Loop Control of the Acid Dyeing of Polyamides", *National Textile Center Annual Report,* pp. 265–266 (Aug. 1995).

"Automatic metering of liquid chemicals and textile auxiliaries" *Melliand International,* p. 208 (3) (1995).

Trotman, *Dyeing and Chemical Technology of Textile Fibres,* 6th edition 1984 pp. 337–339.

CLOSED-LOOP TEXTILE DYEING PROCESS UTILIZING REAL-TIME METERED DOSING OF DYES AND CHEMICALS

GOVERNMENT INTEREST

This invention was made with Government support under Grant No. 533831-83622 awarded by the National Textile Center of the Department of Commerce. The Government has certain rights in this invention.

TECHNICAL FIELD

The present invention relates to dyeing of fibrous articles, and more particularly to a real-time, closed-loop controlled dyeing process that produces outstanding reproducibility and shade build-up on the fibrous article.

RELATED ART

The main focus of applicants' invention is to obtain right-first-time dyeing. Most dye houses use standard dyeing procedures for a particular dyeing system. Since there can be variations from one lot of fabric to another and there can be some errors in the dyeing variables, the standard dyeing procedures may lead to mismatched and unlevel dye lots. These dyed goods may then have to be redyed to get the desired result, and this leads to loss in time and resources. It is therefore the desire of dye houses to get the desired shade with good levelness on the fabric in the first process. Many research and commercial strategies have been tried in the past to accomplish this, mainly to the uptake of ionized dyes by ionic fibers, and these attempts will be discussed hereinbelow.

One popular strategy many dyeing researchers have used is to apply theoretical models to design the dyeing process. The parameters in the model are defined and determined through some initial experiments and the model is then applied to the dyeing process by calculating the dyeing process conditions. One such approach was used in a study by Phillips Fibers Corp. (see, Lenninger, J. C., "Practical Applications of Kinetics in Dyeing", Manuscript, 1974, Phillips Fibers Corporation, Greenville, S.C.) to obtain reproducible dyeing for Nylon 6,6. They used an equation based on first-order kinetics. The constants in the equation were estimated empirically through initial experiments for each acid dye on a given Nylon for a given pH and for the initial dye bath concentration of the dye to below the saturation value of fiber. The constants were found to be the same for compatible or similar affinity dyes. Once the kinetic equation with its constant was established, the temperature profile was predicted from the model. The exhaustion predicted by the model fit very well with the actual data and the results obtained were reproducible.

Cegarra, et al. have used a model equation based on heterogeneous processes and an Arrhenius type temperature dependence, to estimate a temperature profile for controlling the rate of dye uptake (see, "Characteristics of Acrylic Fibers and Kinetics of Dyeing with Cationic Dyes", *TC&C,* 6 (8), pp. 170–174 (1974); and "Communications: Isoreactive Dyeing Systems", *JSDC,* 92 (9), pp. 327–331 (1976)). They try to attain a linear dye uptake, and they have also used an empirical rate equation to control the rate of dye uptake for cationic dyes on acrylic by relating the rate constant to the Arrhenius law (see, "Kinetic Aspects of Dyeing Addition in Continuous Integration Dyeing", *JSDC,* 105(10)(1989)).

A dyeing model based on the Langmuir isotherm has been used to describe the surface concentration of cationic dye on acrylic fiber (see, "The Calculation of Dyeing Processes: Cationic Dye Mixture on Acrylic Fibre", *JSDC,* 95(10), pp. 360–370 (1979)). The application of the model to describe the surface concentration on the substrate is based on the assumption that the concentration of dye sorbed at the surface of the fibers follows approximately that given by the equilibrium sorption isotherm (see, "The Mode of Action of Leveling Agents in the Dyeing of Wool", *JSDC,* 90(5), pp. 158–163 (1974); "Systematic Optimization of Exhaust Dyeing Processes", AATCC Dyeing Symposium (1980)(80); and "Prediction of the Dyeing Behaviour of Disperse Dyes by Computer Simulation of the Dyeing Process", Book of Papers, AATCC National Textile Conference, pp. 220–226 (1987)). Fick's law was then used to describe the diffusion of dye into the fiber from the surface. The equations describing the two phenomena were combined to give an equation describing the uptake of cationic dye by acrylic fiber. Non-linear least squares fitting was then done on the experimental data to get a best fit and to estimate the dyeing parameters. These dyeing parameters were then used to control the exhaustion rate of the process by predicting a temperature profile. Good correlation between the predicted and the actual data was obtained.

A model, though not related to ionic dyes and ionic fibers, was developed by Navratil (see, "Prediction of the Dyeing Behaviour of Disperse Dyes by Computer Simulation of the Dyeing Process", Books of Papers, AATCC National Textile Conference, pp. 220–226 (1987)). It has been claimed that the model takes into account the various parameters such as diffusion coefficients, distribution coefficients, dye solubility, etc. Dyeing processes can be designed using the model to give an on-tone build-up over a large range of shades.

Chemical engineering-type approaches have often been used to control the textile processes. Textile dyeing processes have been correlated to chemical engineering-type processes and the solutions used to solve chemical engineering problems have been applied to textile processes. For example, Burley and Flower (see, "Dynamic Behaviour of Dyeing Machinery and Computer Simulation—Some Examples", *JSDC,* 107, pp. 434–438 (December 1991)) compare the continuous pad-batch and packaging dyeing processes to chemical engineering-type processes. It is suggested that machine dynamics should be considered in addition to the chemical reactions that occur during the dyeing process in order to devise a control scheme. They also suggest using theoretical dyeing models to control the rate of dye uptake. A chemical engineering-type control model incorporating dyeing machinery parameters as control variables was developed by Nobbs (see, "Control Parameters in Dyeing Machinery Operation", *JSDC,* 107 (12), pp. 430–433 (1991)). The model relates the dye uptake to machine parameters. They achieved the control by sensing the dye bath condition and accordingly adjusting the process operation, process temperature, flow rate, and/or flow direction.

Beckmann et al. developed a Telon S method for getting level on-tone dyeings on polyamide fibers with Telon dyes (see, "Systematic Process for Dyeing Polyamide with Anionic Dyes from a Long Liquor", *Melliand Textilberichte,* 55(1), pp. 51–55 (1974)). This is a systematic method of optimizing the process conditions, namely pH, temperature, rate of temperature rise, and amount of leveling agent to be added to the dye bath. The principle behind this method is to select the dyeing conditions in such a way as to get level dyeings right from the start of the process. The conditions chosen depend on the properties of the dye and the substrate, the required depth of shade, and the type of machine.

A Telon ST method for dyeing Nylon has been developed by Weber (see, "Telon ST Process in Carpet Dyeing", *Melliand Textilberichte,* 58(1), pp. 48–51 (1977)). Principally, this method differs from the Telon S method by the way the dye bath exhaustion is controlled. In the Telon S method the exhaustion is controlled by change in temperature, while in the Telon ST method it is done by changing the pH. The temperature in the Telon ST process is kept constant at about the boil temperature throughout the dyeing process. The initial dye bath is alkaline and the pH is reduced during the process by acid addition. The starting pH and the pH at the end of dyeing are determined using a combination diagram. This is similar to the combination diagram used for estimating the starting and the ending temperatures in the Telon S method. The ending pH in the Telon ST process is reached approximately linearly. The bath exhaustion speed is directly proportional to the steepness of the pH change.

Generally, the Telon ST method is preferred to the Telon S method due to its better leveling capability. This is because the rate of exhaustion at a fixed low pH and some intermediate temperature will be higher than at high temperature and some intermediate pH. Also due to high pH and constant high temperature, the values for the distribution coefficient of the dyes in the mixture will be equalized and therefore the dyes will uniformly dye the substrate. The Telon ST process may also require leveling agents. Since the dyeing is carried out at high temperature, the physical fiber structural differences are covered up and the diffusion speeds of the dyes are also evened out. Therefore, it is easier to control dye uniformity using the Telon ST method than using the Telon S method.

A DOSACID® pH-control and dispensing unit has been developed by Ciba and Polymetron AG (see, *Textilveredlung,* 13, 300 (1978) and *Textilveredlung,* 14, 1066, 1075, 1102 (1979)). This system measures the pH of the dye bath and keeps it at a pre-set level by dosing in dilute sulfuric acid or caustic soda. Based on this system Becatron AG developed a DOSACID W® system (see, "Continuous pH Control in the Dyeing of Wool, Wool/Nylon and Wool/Acrylic Blends", *JSDC,* 100, pp. 50–56 (1984)). This system has an added PD and a PID controller to adjust the pH according to the exhaustion of the dye bath and consequently has a better control of the dyeing process. This system has been used to dye wool, wool/nylon, and wool/acrylic blends with acid, cationic and reactive dyes.

A method, similar in some respects to the Telon ST process, has been developed by DuPont (see, "A New High-Value Process for dyeing Nylon: An Overview, Book of Papers, Dyeing Symposium", pp. 191–202 (1992); and "The Fiber as an Energy Barrier, Part II, A New High-Value Process for Dyeing Nylon", Book of Papers, Dyeing Symposium, pp. 203–233 (1992)). The process they have designed is called the INFINITY® process. In this process both the temperature and the pH of the dye bath are kept constant throughout the process, but the dyestuffs are dosed into the dye bath to control the rate of exhaustion. The dyestuffs are dosed in such a way that the dye bath is essentially clear during the process, i.e. all the dye added is taken up immediately by the substrate. In the INFINITY® process, only the fibers at and near the surface of the fiber bundle are dyed preferentially. This is in contrast to conventional dyeing in which all the fibers are dyed. In spite of this feature, the fabric is uniformly dyed at the macroscopic level.

The conditions used in the INFINITY® process are based on the dyes used and the depth of shade required. The process is designed so as to allow minimum dye transfer to the inner fibers. This is achieved either by using shorter dyeing times, or higher bath temperature, or low pH, or by using high affinity dyestuffs, or a combination of all these conditions. Low dye transfer helps in attaining high color yield due to ring dyeing.

The fabric dyed using the INFINITY® process has very good uniformity, quality and consistency. The process is reproducible and cheap. It involves smaller amounts of dyes and auxiliaries, and can be carried out in shorter dyeing times. The dye bath can be reused after one process. The process is therefore environmentally friendly and increases industrial plant capacity due to the shorter dyeing times.

Dosing has been used to control the dyeing of cotton with reactive dyes (see, "Optimierung des Ausziehverfahrens", *Textilveredlung,* 21(7/8) pp. 245–252 (1986); "Exhaust Dyeing—An Anachronism, or a Modern, Future—Oriented Processing Technique?", *Textil Praxis International,* (4), pp. 411–417 (1987); and "Modern Process Technology for Reactive Dyes: Linear Metering of Alkali and Reduction of Salt Additions in the Dyeing of Cellulosic Fibers with Levafix E/EA/EN Dyestuffs", *Melliand Textilberichte,* 69(12), pp. 895–904 (1988)). Alkali is dosed to control the fixation rate of reactive dyes. Fiegel et al. have also controlled the dyeing of cellulose/synthetic blends by dosing dyestuffs and chemicals into the dye bath (see, "Economical and Reliable Dyeing of Cellulosic/Synthetic Fibre Blends in a Long Liquor Through the Automatic Metering of Dyestuffs and Chemicals", *Melliand Textilberichte,* 67(12) pp. 887–892 (1986)). They first dye the synthetic component, polyester or polyacrylonitrile, and then dose the reactive dye into the bath along with alkali to dye the cellulosic component. Dyeing of wool with acid dyes and acrylics with cationic dyes have been controlled by dosing of the dyestuffs and chemicals at a constant temperature by Cegarra et al. (see, "Kinetic Aspects of Dye Addition in Continuous Integration Dyeing", *JSDC,* 105(10) (1989)).

In all the above approaches to textile dyeing the process is designed before the actual dyeing is carried out. Although the conditions are chosen based on certain principles, the process may not actually give the desired results. There can be some changes in the process variables due to various reasons that are not under the dyer's control. These variations can cause irreproducible results. Applicants thus believe that it is important to measure the dye bath real-time and change the process variables real-time so as to obtain a desired exhaustion level.

A COLOREX dyeing machine for measuring the dye bath concentration has been described by Nikko (see, "Automatic Control System for Dye Exhaustion and its Application in Laboratory and Dyehouse", *Melliand Textilberichte,* 69(4), pp. 278–280 (1988)). This machine has a photometric device which measures the dye bath concentration and controls the dye bath exhaustion by changing the pH, temperature, and salt concentration. The publication, however, does not disclose the details of the process used to change the temperature, pH or salt concentration in order to affect the dye bath exhaustion level.

Another on-line dye bath measuring unit developed by Carbonell is the TEINTOLAB® dyeing machine (see, "The On-Line Analysis of Dyeing Processes—A Useful Supplement to the Process Automation Chain", *International Textile Bulletin Dyeing/Printing/Finishing,* (2), pp. 36–42 (1991)). Here the dyeing process is controlled by using the knowledge gained from dyeing experiments. The sensitivity of the process kinetics to changes in temperature, salt concentration, and pH is measured and used to control the process. The machine parameters are also measured and related to dyeing parameters and the information is used in the control algorithm.

A real-time dye bath monitoring system has also been developed by the Dye Applications Research Group (D.A.R.G.) in the College of Textiles at North Carolina State University in Raleigh, N.C. (see, "Real-Time Data Acquisition in Batch Dyeing", *TC&C,* 23(6), pp. 23–27 (1991); and "Real-Time System for Data Acquisition and Control of Batch Dyeing", 1994 IEEE Annual, Textile, Fiber and Film Industry Technical Conference, *IEEE Catalog* No. 94 (CH3395-1)(May, 1994)). This system has been used to control the uptake of direct dyes by cotton. An adaptive control technique has been combined with the theoretical Langmuir kinetics model to control the exhaustion rate (see, "A Novel Approach to Modelling and Controlling Dyeing Processes", Book of Papers, Dyeing Symposium, pp. 161–181 (1992)). The parameters in the Langmuir model are estimated using the dye bath data measured in real-time. Only temperature was used to control the final exhaustion, and this was estimated using the Langmuir model and the dye bath data.

A non-parametric fuzzy logic control model, has also been used to control the dye bath exhaustion. This model utilizes the strategies used by an experienced dyer in making the decisions for the process (see, "Improving Computer Control of Batch Dyeing Operations", *ADR* (1993)). The control decisions of an expert can be expressed linguistically as a set of heuristic decision rules to generate quantitative control outputs. This control model has also been used by researchers in the Dye Applications Research Group in the College of Textiles at North Carolina State University, with promising results (see, "A Self-Learning Fuzzy Logic Controller with On-line Scaling Factor Tuning", The Conference of International Society of Computer Applications, Los Angeles (March, 1994)).

However, despite the substantial efforts that have been devoted to dyeing research, there remains a long-felt need for a right-first-time commercial dyeing process that produces excellent reproducibility and shade build-up. Applicants have now discovered such a process and the details thereof are set forth hereinbelow.

SUMMARY OF THE INVENTION

The invention provides an improved process for the dyeing of a fibrous article with at least one dye. A process in accordance with the invention includes immersing said fibrous article in a suitably heated liquid bath of a solvent medium for said dye wherein said liquid bath has a predetermined alkaline pH. Acid is added to the dyeing bath during dyeing to reduce the pH according to a predetermined profile that is responsive to real-time measurements of dyeing bath pH, and dye is added to the dyeing bath during dyeing as a liquid concentrate in a variable manner that is responsive to real-time calculations of dye uptake by the fibrous article. A determination is made in real-time during dyeing of (1) the solution concentration of the dye in the dyeing bath and (2) the amount of the dye added to the dyeing bath, and the dye uptake by the fibrous article is then calculated from (1) and (2). The rate of addition of the dye to the dyeing bath is then adjusted during dyeing in accordance with the real-time calculated dye uptake by the fibrous article.

In one representative use of the invention, the dyeing of Nylon is controlled so as to obtain an on-tone build-up of shade using a binary mixture of acid dyes. The closed loop dyeing process is controlled by controlling the dye bath pH and the individual concentrations of the two acid dyes in the dye bath using computer controlled dosing pumps, and the real-time, closed-loop control process as utilized according to the invention produces outstanding reproducibility and shade build-up on the Nylon fibrous article.

In another representative use of the invention, the exhausted dye bath can be reused since it contains so little dye after completion of the novel dyeing process of the invention. In this use as well as the previously discussed use of the invention, the fibers being dyed no longer have the conventional role of controlling how rapidly one or more dyes in the dyeing mixture are absorbed, but instead calculations are made of (1) the amount of dye that has been added to the dye bath and (2) that is on the fiber, and separate adjustments are made to each metered dye dosing rate to assure correct dye uptake by the fiber as a function of time according to a predetermined dyeing plan.

It is therefore the object of the present invention to provide an improved dyeing process providing outstanding on-tone shade build-up using one or more dyes, and preferably two or more acid dyes, in a solvent medium to dye a fibrous article, preferably a nylon fibrous article.

It is another object of the present invention to provide an improved dyeing process for dyeing Nylon with one or more acid dyes, and preferably a mixture of two or more acid dyes, that results in an outstanding on-tone build-up of shade and outstanding reproducibility.

It is still another object of the present invention to provide a dyeing process for dyeing fibrous articles with at least one dye, and preferably two or more dyes, wherein the exhausted dye bath contains so little dye that it can be reused in the process of the present invention.

It is still another object of the present invention to provide a dyeing process that provides for dosing individual dyes separately in dye mixtures to produce a superior on-tone shade build-up during dyeing.

It is still another object of the present invention to provide a dyeing process that eliminates the need for utilizing the conventional drug room during dyeing of fibrous articles.

Some of the objects of the invention having been stated, other objects will become evident as the description proceeds, when taken in connection with the accompanying drawings described in detail below.

BEST MODE FOR CARRYING OUT THE INVENTION

Figure 1:
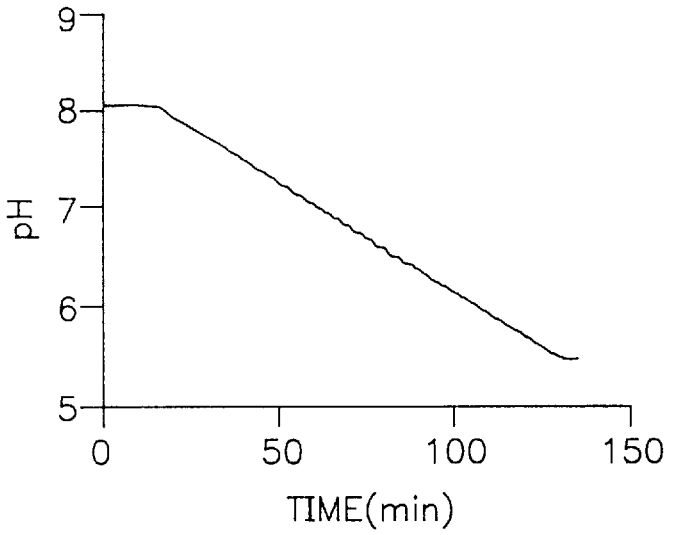
FIG. 1 is a graph illustrating the change in pH over time for controlled dyeing Example 1.
Figure 2:
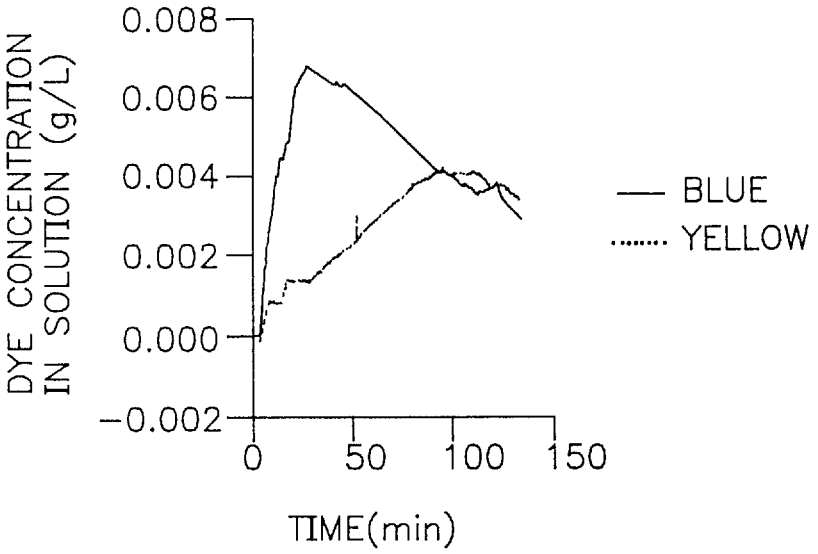
FIG. 2 is a graph depicting change in solution concentration of CI Acid Blue 25 and CI Acid Yellow 49 over time for controlled dyeing Example 1.
Figure 3:
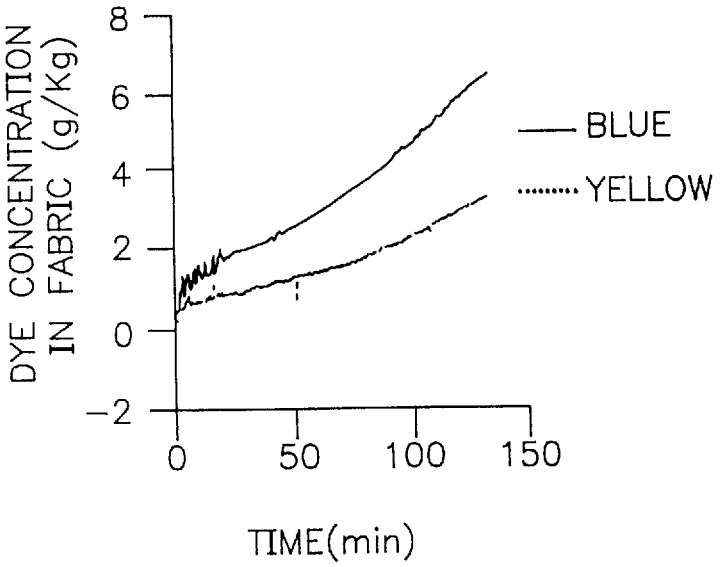
FIG. 3 is a graph illustrating change in fabric concentration of CI Acid Blue 25 and CI Acid Yellow 49 over time for controlled dye Example 1.
Figure 4:
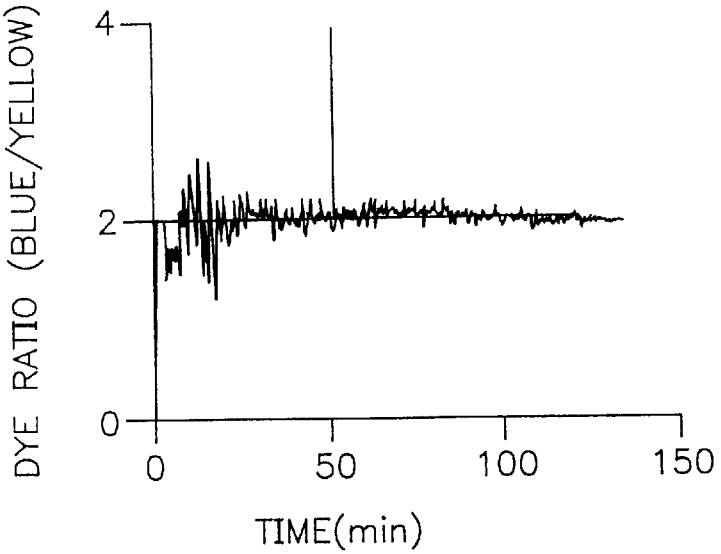
FIG. 4 is a graph illustrating change in the ratio of the fabric concentration of CI Acid Blue 25 and CI Acid Yellow 49 over time for controlled dyeing Example 1.
Figure 5:
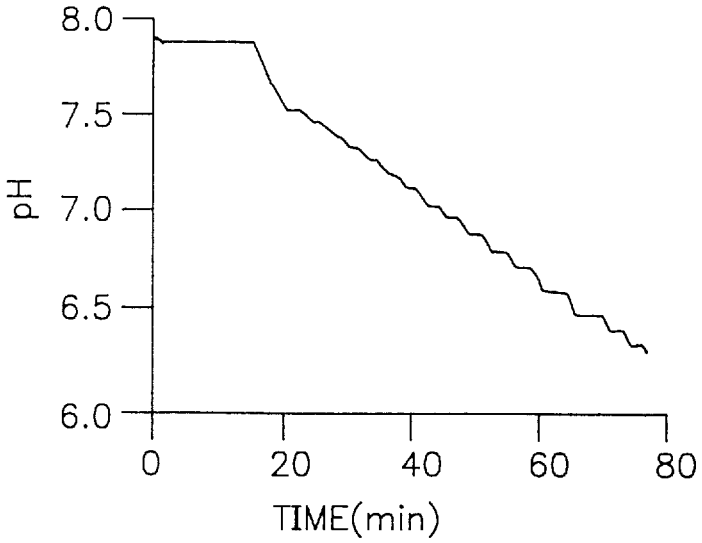
FIG. 5 is a graph illustrating change in pH over time for controlled dyeing Example 2.
Figure 6:
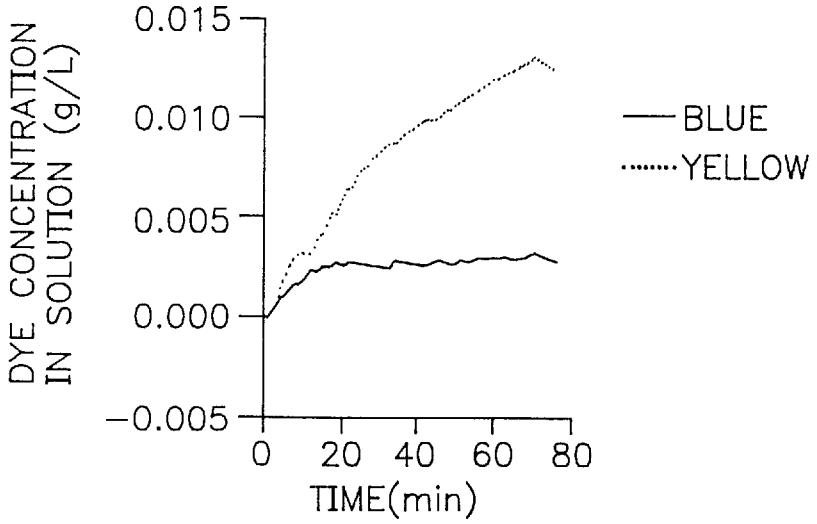
FIG. 6 is a graph illustrating change in solution concentration of CI Acid Blue 25 and CI Acid Yellow 49 over time for controlled dyeing Example 2.
Figure 7:
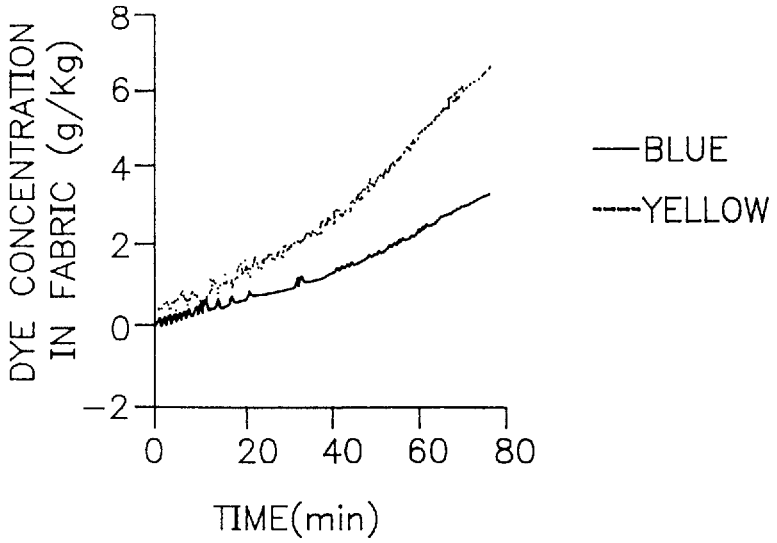
FIG. 7 is a graph illustrating change in fabric concentration of CI Acid Blue 25 and CI Acid Yellow 49 over time for controlled dyeing Example 2.
Figure 8:
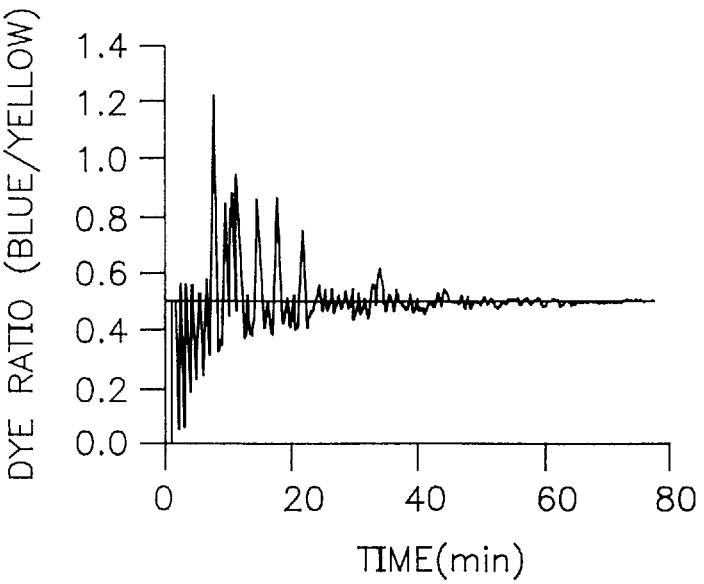
FIG. 8 is a graph illustrating change in the ratio of the fabric concentration of CI Acid Blue 25 and CI Acid Yellow 49 over time for controlled dyeing Example 2.
Figure 9:
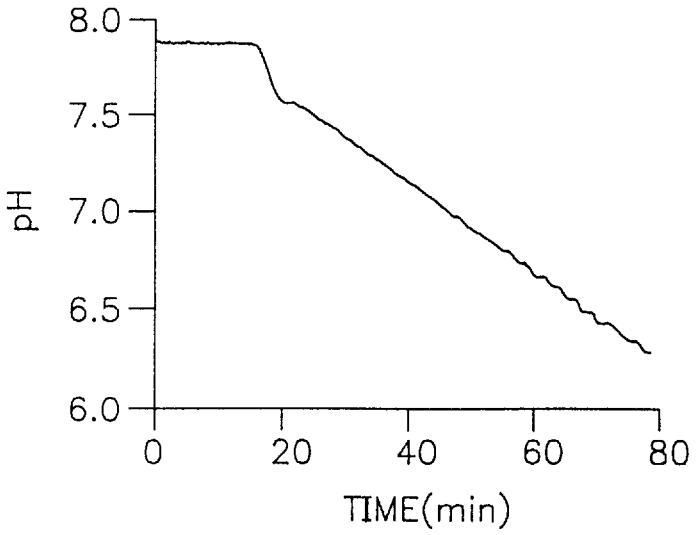
FIG. 9 is a graph illustrating change in pH over time for controlled dyeing Example 3.
Figure 10:
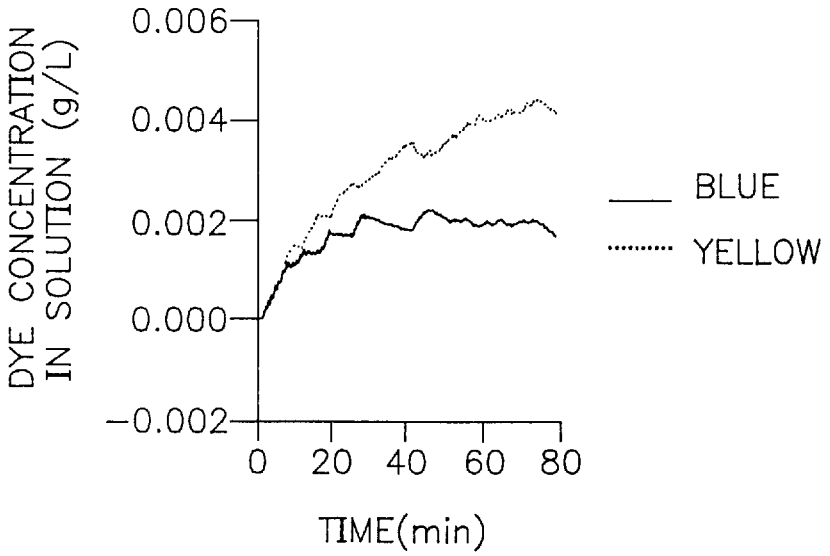
FIG. 10 is a graph illustrating change in solution concentration of CI Acid Blue 25 and CI Acid Yellow 49 over time for controlled dyeing Example 3.
Figure 11:
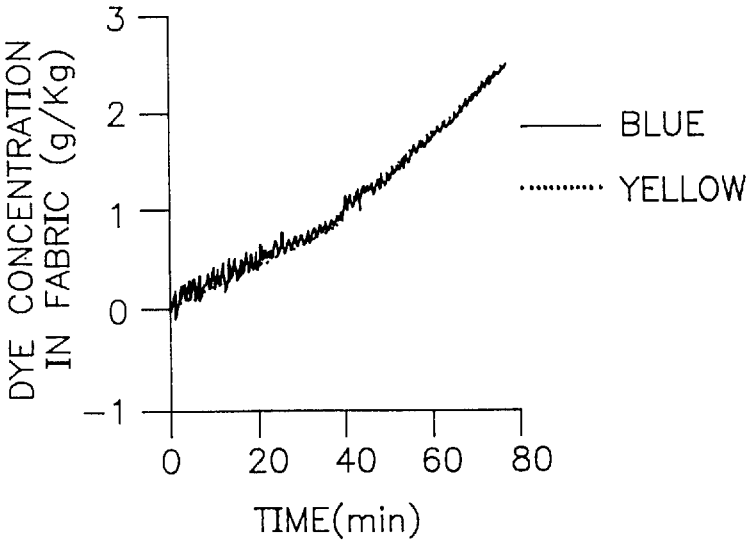
FIG. 11 is a graph illustrating change in fabric concentration of CI Acid Blue 25 and CI Acid Yellow 49 over time for controlled dyeing Example 3.
Figure 12:
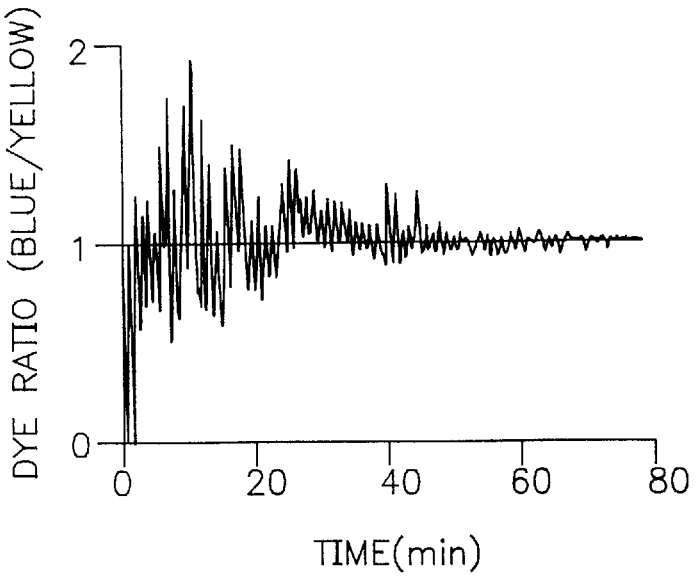
FIG. 12 is a graph illustrating change in the ratio of the fabric concentration of CI Acid Blue 25 and CI Acid Yellow 49 over time for controlled dyeing Example 3.
Figure 13:
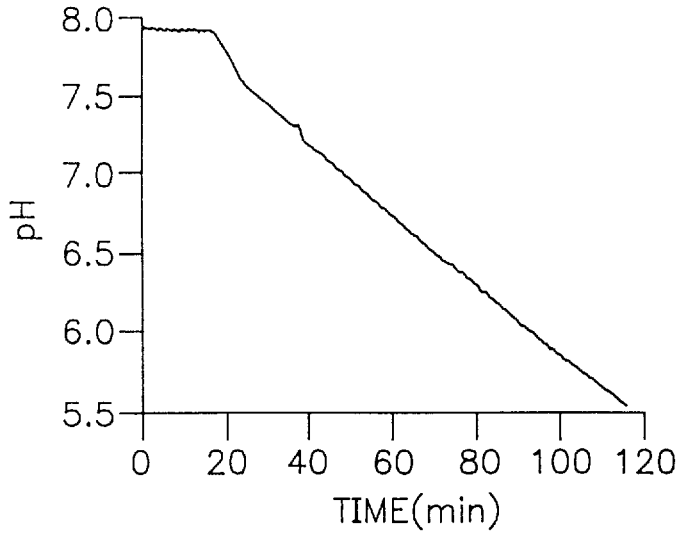
FIG. 13 is a graph illustrating change in pH over time for controlled dyeing Example 4.

Most commercial dye houses use standard dyeing procedures for a particular dyeing system. Since there can be variations from one lot of fabric to another and there can be errors in the dyeing variables the standard dyeing procedures can lead to mismatched and unlevel dye lots, and these goods then have to be redyed to get the desired results. This leads to a loss in time and resources, and thus it is the aim of the dye houses to get the desired shade with good levelness on the fabric in the first process run. Right-first-time dyeing makes the dyeing processes more economical, and reduces pollution and energy consumption. Many efforts have been made in the past to accomplish this end, but the results have been mixed. Applicants have discovered a dyeing process that successfully addresses this well-known problem in dyeing, and that provides excellent right-first-time dyeing.

Although applicants' novel dyeing process can be used in virtually all dyeing systems, applicants believe that it is particularly well suited for ionic dyeing systems in which the dye ion is a counter-ion at acidic pH values. Representative examples are the dyeing of polyamide fibers and protein fibers such as wool and silk with anionic dyes. For the preferred embodiment of the invention described herein, applicants will describe the dyeing of Nylon 6,6 fibrous articles with acid dyes, but the invention is not intended to be limited in any manner whatsoever to either use of acid dyes or to the dyeing of Nylon fibers.

Applicants' objective in testing described herein was to control the dyeing of Nylon with acid dyes by dye and chemical metering in such a way as to:

1. obtain an on-tone build-up of shade throughout the process while using binary mixtures of dyes;
2. ensure that the dyed substrate showed minimal barre' effects (i.e., so that there is no significant yarn-to-yarn variability in dye uptake, and the dyeings are level);
3. eliminate the use of surfactants and retarders and thus minimize effluent pollution;
4. permit the reuse of dye bath; and
5. eliminate the need for dyeing recipes, and manual weighing of dyes.

Applicants believe that it is important to identify the problems associated with the dyeing of Nylon with acid dyes before proceeding further with the description of the invention. One important and perceivable problem in dyeing Nylon fabrics is dye non-uniformity or barre'. When a Nylon fabric is dyed with acid dyes, the dye may be taken up in different amounts by the yarns in the fabric. This may either be due to configurational or dye-on-fiber differences.

As is well known to one skilled in the dyeing art, configurational differences are physical and optical differences. These can be due to differences in the physical properties of the yarns, and differences in the glass transition temperature can also cause variations in dyeing rates and thus lead to undesirable barre' dyeing.

Dye-on-fiber differences can be due to variable dye capacity or variable dye uptake of the different fibers forming the fabric. The dyes that are rate-sensitive can also cause barre' (e.g., Milling and Pre-metallized dyes that are di- or polysulfonated). Barre' is caused due to the failure of these dyes to equilibrate.

Configurational differences are difficult to remove once the fabric with different yarns has been made. Yarns with almost the same physical properties should be selected while making the fabric to avoid any configurational barre', unless a special effect is desired after dyeing the fabric. Extended dye cycles at higher temperature can help to reduce the configurational differences due to different heat histories of the yarn. Water opens up the fiber structure at higher temperatures due to which the dye can more easily migrate to cover barre'.

In order to avoid dye-on-fiber differences, yarns with the same heat history should be used and they should have similar molecular orientation. Leveling dyes can cover the rate differences between the fibers when dyeing is carried out for a long time. Barre' coverage for rate sensitive dyes can be achieved by using anionic blocking agents to compete with the dyes for the dye sites. In order to get level dyeing it is known in the prior art to design a process so that the dye uptake rate is less than 2% of the dye present in the bath per machine or process cycle.

It is also known that dye unlevelness due to variations in the diffusion coefficient due to structure differences can probably be overcome by starting the dyeing at a temperature above the glass-transition temperature of the fibers. This will provide the energy for the different fibers in the substrates to equalize the structural differences caused earlier by variations in their heat treatments. In this manner, the variations in diffusion coefficients of the dyes caused by fiber structure differences can be eliminated and the unlevelness due to this factor can be reduced.

Another well-known problem of dyeing Nylon with acid dyes is that when dyeing is carried out using a mixture of dyes the acid dyes used are typically incompatible when used in mixtures. This is due to the limited number of dye sites on the fibers and due to differences in the distribution coefficient of the dyes, which affect the rate at which they are taken up by the Nylon substrate. The distribution coefficient is dependent on the dye structure, molecular weight, and the degree of sulfonation. This problem is presently addressed by using compatible dyes or dyes having similar affinity and degree of sulfonation. However, this is not a practical solution, and applicants have discovered a significantly more practical methodology for solving this problem and for commercial use in industry.

(A) APPLICANTS' NOVEL CLOSED-LOOP, REAL-TIME CONTROL DYEING PROCESS

Applicants have developed a feedback control process wherein the control has been gained by controlling the pH and the individual concentration of one or more dyes (herein two) in the dye bath. The solvent medium of the dye bath is preferably aqueous (water adjusted with ammonium hydroxide), although other solvent mediums could be used such as water alcohol mixtures and glycol water. The dyeing process is started at alkaline pH to avoid high strike rate of the dye on the substrate in the beginning of the dyeing process and therefore, to prevent or minimize unlevelness. The pH of the dye bath is then dropped in a predetermined way, using a combination of 1N and glacial acetic acid solutions. Of course, other single acids or combinations of acids could be utilized such as hydrochloric acid, sulfuric acid and formic acid, and acids such as phosphoric acid and citric acid which are commonly used as the basis for chemical buffer systems.

Various rates of dosing were tested to optimize the process and to get the desired pH control. The optimum pH profile discovered was to maintain the pH at the starting pH of about 8.0 for 15 minutes, bring the pH down to about 7.0 in 10 minutes, and then further bring the pH down to about 5.0 in 90 minutes. The optimum temperature of dyeing was found to be 82° C. Applicants note, however, that this is merely one pH profile and that many others could be used as a matter of choice by one skilled in the dyeing art. This is also true with respect to the optimum or preferred dyeing temperature.

Since applicants desired to control the ratio of the two acid dyes on the Nylon fabric throughout the dyeing process, it was necessary to estimate the amount of each dye taken up by the substrate at various time intervals. This was done by estimating the solution concentration of the dye bath in real-time, using a dye bath monitoring system described in detail in Section (B) hereinbelow, and by calculating the amount of dye dosed into the dye bath. The ratio of the two dyes (CI Acid Blue 25 and CI Acid Yellow 49) on the fabric was then calculated and compared to the desired ratio of the two dyes on the fabric. A limit of acceptability was fixed for this ratio. This was decided to be equal to 0.005. Thus, if the ratio of blue:yellow dyes (desired ratio=1.000) became more than 1.005, only the yellow dye was dosed, and if it became less than 0.995, only the blue dye was dosed. But if the ratio was between 0.0995 and 1.005, both of the dyes were dosed into the dye bath. This ratio can vary, of course, according to the specific dyeing process being used and the desired result.

An optimum dosing scheme for dosing the dyes was discovered by applicants. According to this discovery the dosing of the dyes was done in such a way that initially when the total amount of dye added to the dye bath was less than the total amount of dye to be taken up by the fabric, the rate of dosing was high. Thereafter, the rate of dosing was reduced so as to avoid a high build-up of the dyes in the dye bath. Initially the amount of dye dosed per cycle was:

$$\text{Amount of dye added per cycle} = \text{Total dye required on the fabric}/15$$

and when all the dye that needed to go on to the fiber had been added, it was reduced to:

$$\text{Amount of dye added per cycle} = \text{Total dye required on the fabric}/30$$

When 90% of the dye had gone onto the fabric the dosing of the dyes was stopped, to avoid further build-up of dye in the bath. These dosing values also, of course, can vary according to the specific dyeing process being conducted, and the result desired.

(B) REAL-TIME CONTROL SYSTEM USED FOR APPLICANTS' NOVEL DYEING PROCESS

A real-time system was developed for the monitoring and control of the batch dyeing processes. The system, though developed for batch dyeing, is a generic data-acquisition and control system compliant with POSIX and other standards. The system provides for the rapid prototyping of general real-time data acquisition and control systems, while supporting a large set of development tools to enable networking, WINDOWS™-based applications programming, and object-oriented programming.

Currently, applicants' system combines a real-time multitasking operation system with full TCP/IP networking support. Using a VMEbus backplane, the system can also support multiple CPU's and full bus arbitration. Various drivers have been written to enable A/D, D/A, DIO, as well as serial and parallel communications (RS232).

The backbone of applicants' system consists of a MOTOROLA MVME 167 single board computer. The single-board computer has an onboard 33 MHz 68040 CPU, with 8 Mbyte of onboard RAM. The operating system, VxWorks, is a POSIX complaint real-time operating system. The real power of the system lies in its ability to interface via TCP/IP with other machines on the network. The Input/Output hardware includes 16 channel A/D, 2 channel D/A, and 16 bits of digital I/O. Also, the computer has a GPIB port, 4 serial ports (RS 232), a parallel port, a SCSI port, and an Ethernet port.

Figure 17:
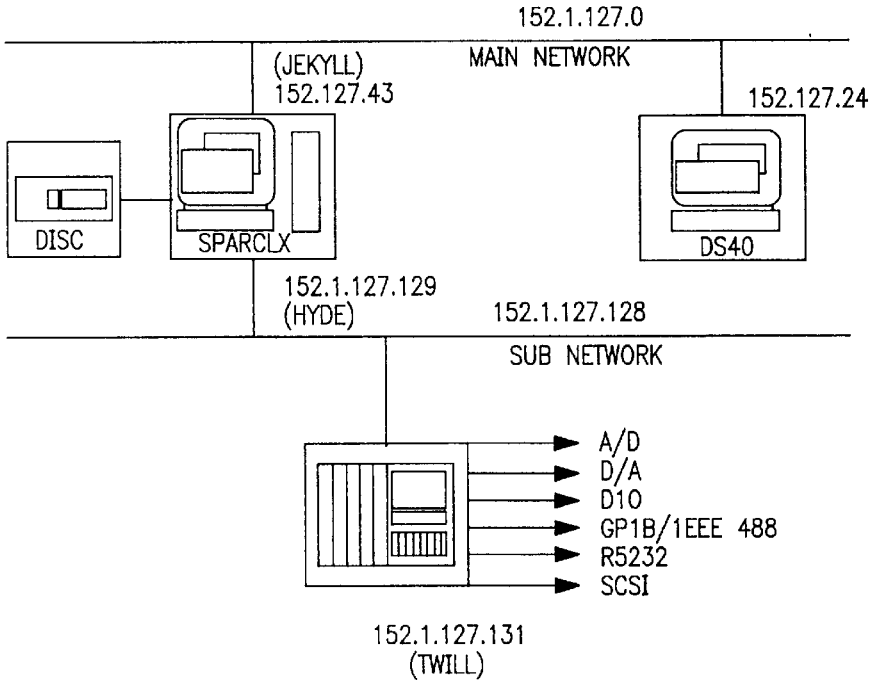
FIG. 17 is a schematic drawing of the network configuration of the dyeing process control system.
Figure 18:
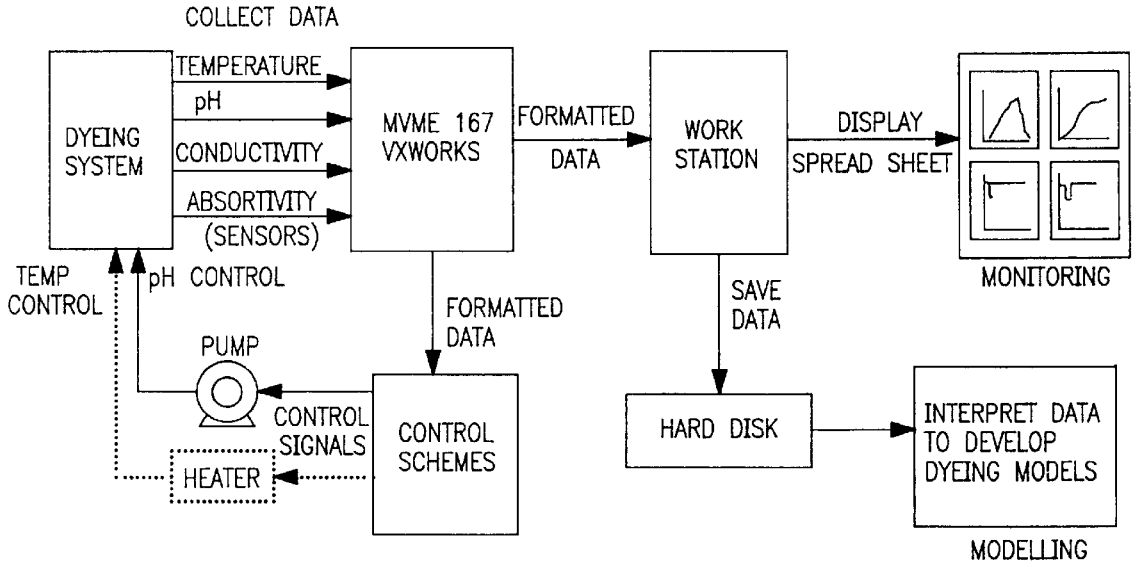
FIG. 18 is a schematic drawing of data flow on the dyeing process control system shown in FIG. 17.

All of the data collected by the system, consisting of temperature, pH, conductivity, and absorbance spectra, are formatted and time-stamped. The data is sent over the network to the host machine. The network configuration is shown in FIG. 17 of the drawings. A software program running on the host machine reads the data, writes it to a spreadsheet and displays the process parameters. FIG. 18 shows a flow diagram of the data on the control system.

The dye bath temperature is controlled with relays connected to heating and cooling elements. A temperature controller, running as a background process, regulates the dye bath temperature using a modified pulse-width-modulation technique. Through function calls, other processes can change the desired temperature set point.

Four SCILOG high precision pumps (4) are connected to the computer through serial communication ports. The pumps can be used for dosing precise quantities of concentrated dye solutions, acid(s) and/or base or configured as may otherwise be desired. The system thus has the capability to change dye concentration, salt concentration and pH of the dye bath. The versatility of the system is such that it can determine appropriate process conditions for controlling the process and by controlling suitable actuators can achieve the desired process conditions. The process control and the parameter control can follow very different strategies.

Applicants' original system design was to connect the real-time computer to the main network via thinline Ethernet. However, during times of heavy internet traffic, it was observed that data was lost in transmission. The nondeterministic nature of TCP/IP did not provide a robust environment for data transfer. To improve the network integrity, applicants installed a second Ethernet card on the SUN host workstation, which connected to a subnet. The host acted as a gateway and a router from the real-time system to the main network. This isolated network traffic when the real-time system accessed the host's hard disk, but also allowed users on the internet access to the data.

Applicants' real-time control system is compact and portable. It can be moved from one room to another and easily reconfigured for rapid prototyping.

An original monitoring program, called XPHDYE was written on the host or SUN Workstation side to display the dye bath data in real-time. XPHDYE is a Motif wrapper program which spawns XESS, a spreadsheet. The program makes a connection to the spreadsheet, reads the information from the data acquisition system, and writes it onto the spreadsheet, thus using the spreadsheet as a database. The program also allows the user to select among 8 different graphs. The graphs are automatically updated when new data is written into the spreadsheet. The types of data which are plotted are temperature, conductivity, pH, the absorbance spectrum, absorbance, concentration of dye in solution, concentration of dye on the fabric, and the ratio of the two dyes in solution (for a two dye mixture).

Applicants note that although the hardware and software described above provide an excellent system to control applicants' novel dyeing process, other control systems can be designed and used as a matter of design choice to practice applicants' novel dyeing process, and applicants' invention is not intended to be limited to use of the specific control system hardware and software described herein.

(C) OPERATING PROCEDURE TO RUN APPLICANTS' DYEING PROCESS ON CONTROL SYSTEM

Using the control system described above, applicants' dyeing process can be practiced as follows:

1. Switch on a Guided Wave Spectrophotometer (GWS) at least an hour before the test is to be conducted.
2. Make the necessary changes to the control program before starting the dyeing process. The pH profile will have to be decided upon and the function ("phControl") will have to be modified based on the desired pH profile for the specific dyeing procedure. The rate at which the dyes have to be dosed can be entered in the function "dye_dose". If the dye bath is being reused, then the mass of the dyes in the dye bath in the beginning of the experiment will have to be entered in the function "dose_data". The volume of the dyes, on the basis of their stock solutions, will also have to be entered as default initial values for the variable, "dye_vol[i]". The program is located in the directory on VxWorks. The program will have to be recompiled after the necessary changes have been made to it. The program can be recompiled by typing "make" and pressing <return>. The "phdye6.o" file created after compilation will have to be copied to the "~/root/twill" directory. The program will also have to be loaded on the VxWorks by typing "ld<phdye6.o" on the prompt.
3. Start the AHIBA dyeing machine and raise the temperature to the desired temperature for an isothermal dyeing. This is done by first turning the power on and then following the instructions on the box.
4. Insert the pH probe into the middle section of the three section manifold.
5. Start the circulation pump while the temperature of the dye bath is being raised.
6. Attach the fiber optic cables to the probes and the GWS ports.
7. When the desired temperature has been reached, take a reference of the dye bath liquor. This is done by running the "MONITOR" program on the PC in the directory "c:\gwi". Type "MONITOR" on the PC, while in the directory "C:\gwi", and press <return> to run this program. Press <references> to take the reference of the dye bath. While taking the reference, make sure that there are no bubbles in the circulation liquor passing through the probes. The bubbles can be removed by changing the flow direction on the circulation pump, and switching it back to the initial flow direction.
8. Calibrate all of the precision piston pumps using the procedure given in the manual for these pumps from SciLog.
9. Run the pumps at the desired speeds for one minute and measure the amounts delivered by them. Calculate the rate of delivery for the pumps at each of these rates. These values can be entered into the functions "phControl" and "dye_dose", which control the pH and the concentrations of the two dyes in the dye bath, respectively, in the control program "phdye6.c". This data will be used by the program to calculate the exact amounts of the chemicals dosed into the dye bath.
10. Connect the pumps to the VXWORKS box and enter the address values for each of the pumps. Applicants' current program is set-up so that the four pumps corresponding to the following addresses dose the respective chemicals:
    a. Address #0 1NAcetic Acid
    b. Address #1 Glacial Acetic Acid
    c. Address #2 CI Acid Blue 25
    d. Address #3 CI Acid Yellow 49
11. Connect the tubings from the four dosing pumps to the circulation system after the tubes are filled with the respective dosing solutions. This is done by running the pumps for some time and letting the dosing solutions flow out at the other end.
12. Start the program "dose_data" on the VXWORKS data acquisition machine. Enter the values of the parameters asked for the dyeing experiment while running the program. Press <return> to start the control and the data acquisition programs.

(D) CONTROL DYEING TESTS

The dyes used in the tests, CI Acid Blue 25 and CI Acid Yellow 49 available from Crompton & Knowles, were calibrated, both individually and in mixture combinations, on the Guided Wave Spectrophotometer. The piston pumps used for dosing chemicals and the dyes were also calibrated and were found to be very precise. The fibrous articles dyed were Nylon woven fabrics.

A number of tests were carried out with the two dyes individually and in mixtures. The dyeings with one dye were carried out to understand the process and no feedback control for the dosing of the dye was applied. The pH was controlled using a feedback control.

Dyeing tests were first conducted by dosing one dye into the dye bath of the aqueous solvent medium and controlling the pH linearly. This was done to understand the process and to set the dyeing conditions for further tests. No feedback control for the dosing of dyes was applied in this case.

The first test was carried out only with CI Acid Blue 25. The fabric weight used was 73.94 g and it was dyed using 0.25% owf dye at 92° C. The initial dye bath had 2500 mL deionized water. A uniform dyeing was not obtained. The dyeing was very patchy. There were some regions, especially in the inner layers of the fabric, which did not receive any dye solution. This was due to large weight of the fabric used in the machine. The machine did not give a good agitation to the fabric, due to which the dye circulation was not good.

In the next test the amount of fabric was reduced to 3 g, thus increasing the liquor ratio. The fabric was cut into two pieces before mounting on the sample holder to give equal access of the dye bath solution to all regions of the sample. A good level dyeing with 0.25% Acid Blue 25 at 92° C. was obtained using these conditions. A similar dyeing was then conducted with CI Acid Yellow 49 and a good level dyeing was achieved.

When the conditions for good level dyeings were established with each dye individually, dyeings with the two acid dyes in mixture were carried out. Four dyeings were carried out to obtain different shades on the fabric (Examples 1–4). The different shades produced are given below in Table 1. In the fourth dyeing, the dye bath was reused from after the third dyeing test. This was done to show dye bath reusability using applicants' method.

The test conditions for dyeing Examples 1–4 shown in Table 1 below are as follows:

EXAMPLE 1

1. Starting Temperature: 95° C.
2. Solvent Medium: water adjusted with ammonium hydroxide
3. Acid(s): 1N acetic acid and glacial acetic acid
4. Dyeing Time: 130 minutes
5. Fabric: Nylon Heat Set: Yes
6. Liquor Ratio: Approximately 700/1
7. Dye Bath Reused: No
8. Surfactant: None
9. Final Temperature: 95° C.

EXAMPLE 2

1. Starting Temperature: 82° C.
2. Solvent Medium: water adjusted with ammonium hydroxide
3. Acid(s): 1N acetic acid and glacial acetic acid
4. Dyeing Time: 80 minutes
5. Fabric: Nylon Heat Set: No
6. Liquor Ratio: Approximately 700/1
7. Dye Bath Reused: No
8. Surfactant: None
9. Final Temperature: 82° C.

EXAMPLE 3

1. Starting Temperature: 82° C.
2. Solvent Medium: water adjusted with ammonium hydroxide
3. Acid(s): 1N acetic acid and glacial acetic acid
4. Dyeing Time: 80 minutes
5. Fabric: Nylon Heat Set: No
6. Liquor Ratio: Approximately 700/1
7. Dye Bath Reused: No
8. Surfactant: None
9. Final Temperature: 82° C.

EXAMPLE 4

1. Starting Temperature: 82° C.
2. Solvent Medium: water adjusted with ammonium hydroxide
3. Acid(s): 1N acetic acid and glacial acetic acid
4. Dyeing Time: 120 minutes
5. Fabric: Nylon Heat Set: No
6. Liquor Ratio: Approximately 700/1
7. Dye Bath Reused: Yes
8. Surfactant: None
9. Final Temperature: 82° C.

$$\text{Amount of dye added per cycle} = \frac{\text{Total dye required on the fabric}}{60}$$

The first dyeing test (Example 1) was longer than dyeings 2 and 3. This was because the rate of dye dosing when the total dye needed to be on the fabric had been added, was reduced to;

$$\text{Amount of dye added per cycle} = \frac{\text{Total dye required on the fabric}}{60}$$

The pH profile was also less steep compared to in dyeing Examples 2 and 3. This prolonged the dyeing process but the desired control was obtained.

Figure 14:
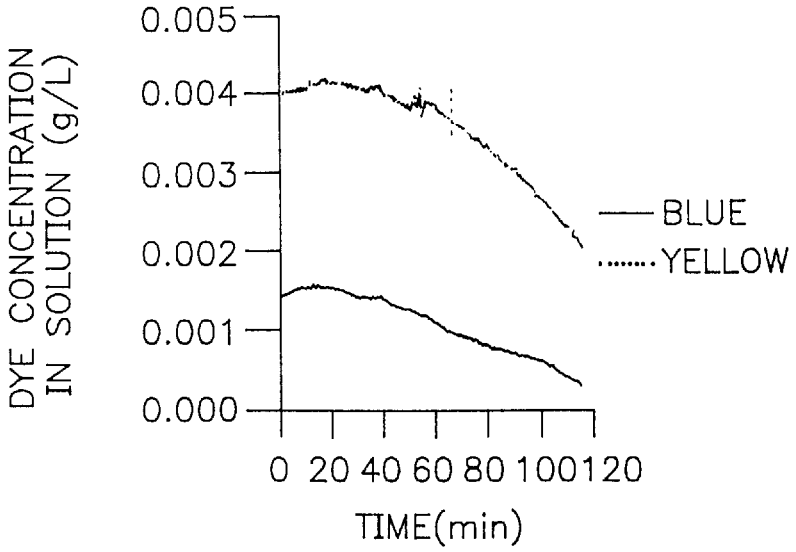
FIG. 14 is a graph illustrating change in solution concentration of CI Acid Blue 25 and CI Acid Yellow 49 over time for controlled dyeing Example 4.
Figure 15:
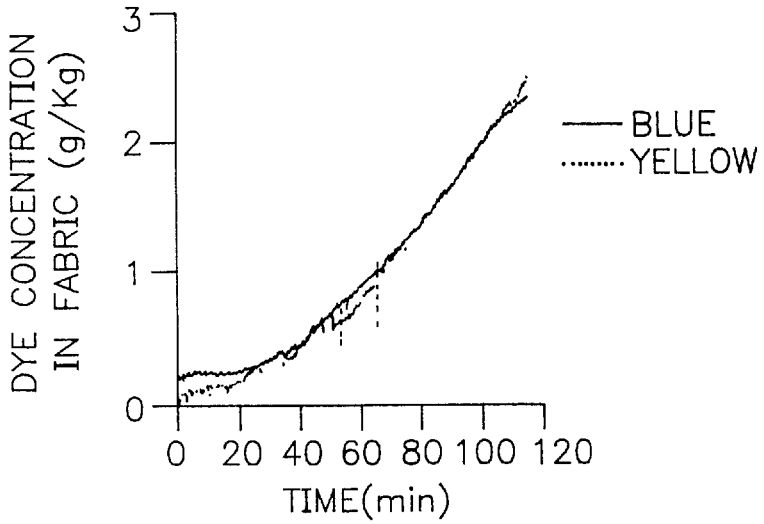
FIG. 15 is a graph illustrating change in fabric concentration of CI Acid Blue 25 and CI Acid Yellow 49 over time for controlled dyeing Example 4.
Figure 16:
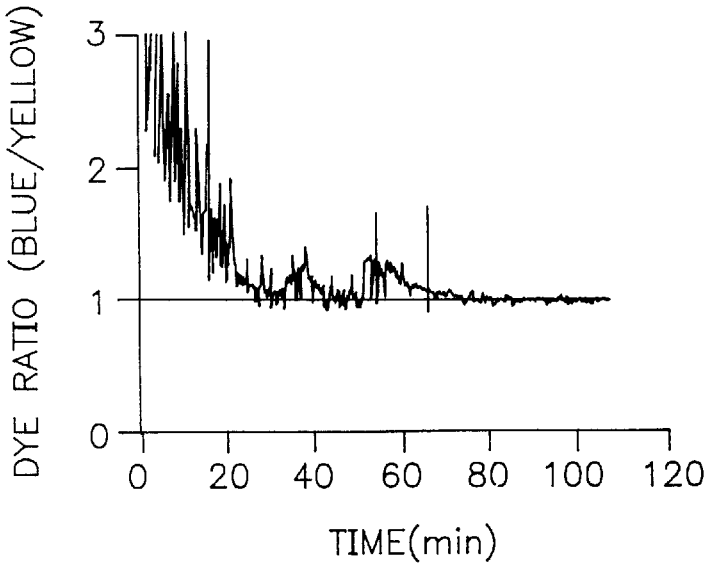
FIG. 16 is a graph illustrating change in the ratio of the fabric concentration of CI Acid Blue 25 and CI Acid Yellow 49 over time for controlled dyeing Example 4.

The results from all the controlled dyeing tests are shown in FIGS. 1–16. FIGS. 1, 5, 9 and 13 show the pH profile during the each of the four tests, Examples 1–4. These figures show that the pH can be controlled as desired during the process, using applicants' novel process. FIGS. 2,6,10 and 14 show the change in bath concentration of the two dyes with time. The concentration of the two dyes in the solution keeps changing and does not follow any particular trend. FIG. 14 shows that the initial solution concentration of the two dyes was high and does not start from zero, because the dye bath initially had some dye left over from the earlier control dyeing test Example 3. FIGS. 3,7,11 and 15 show the change in fabric concentration of the two dyes with time. The two dyes go on to the fabric at the same rate as can be seen from FIGS. 11 and 15, where the desired ratio of the two dyes was 1:1. For dyeing Examples 1 and 2, where the desired ratio was 1:2 and 2:1, blue:yellow, the two dyes are taken up by the fabric in the respective ratio. FIGS. 4, 8, 12 and 16 show the change in the ratio of the two dyes with time, especially in the initial stages of the process. This is because initially very small amounts of dye was absorbed by the fabric and when the small numbers are divided, the ratio becomes too large or too low. The fabric dyed uniformly with some warp yarn variations in the case where the fabric had not been heat-set. But when the Nylon fabrics were heat set at 200° C., the dyed fabric did not show any warp yarn dyeing variations.

(E) SUMMARY OF CONTROL DYEING TESTS

The desired on-tone shade build-up was obtained using the two acid dyes in mixtures. Three different shades 1:1, 1:2, and 2:1, blue:yellow, were produced. The dyeings were controlled by pH and the concentration of the two dyes in the dye bath. The pH and the concentrations of the two dyes were controlled by dosing the acid and the two dyes into the dye bath, using the dosing pumps controlled by the computer. Applicants' tests show that an on-tone build-up of shade can be obtained, and it should be possible to avoid blocking effects by using the novel dosing procedure.

A number of tests were conducted to optimize the process time and also to improve the levelness of the dye fabric. Very large liquor ratio was used for these tests because the dye circulation was not efficient in the dyeing machine used by applicants. It was also shown that the dyeing process can be controlled well even if the dye bath is reused (Example 4). These experiments were conducted in the absence of any surfactants in the dye bath. It was observed that starting the dyeing at high temperature (95° C. in Example 1 versus a temperature of 82° C. in Examples 2–4) does not help cover yarn variations. The problem of barre' effects observed due to warp yarn variations were eliminated by heat-setting the fabric. Applicants have therefore shown that using the novel process to control via real-time the adaptive dosing of the dyes and the related dye bath chemicals has great commercial promise for right-first-time dyeing.

Very significantly, applicants' novel dyeing process can be used to eliminate the traditional dye drug room by utilizing pre-packaged liquid dyes for metered dosing by the precision pumps. Elimination of the drug room will effect significant cost savings for industrial users of the novel dyeing process.

Although applicants' novel dyeing process has been described in use with two (2) acid dyes to dye Nylon 6,6 fabric, other numbers of dyes and combinations of dyes and fabrics can be used practicing applicants' process and all are intended to be within the scope of applicants' invention. These other representative dyes and fabrics include, but are not limited to, the following: dyeing of polyamide fibers and protein fibers such as wool and silk with anionic dyes. In some cases, such as the application of milling acid dyes or neutral dyeing acid dyes to wool, applicants' further contemplate that their process could begin with a near neutral or even slightly acidic pH value of the dyeing bath (e.g., about 6.0–7.0 pH value). Furthermore, although applicants' novel process has been described in its preferred use with metered dosing of two (2) dyes, applicants contemplate that the inventive process can also be used with metered dosing of a singular dye into a dye bath and also dosing of three dyes into a dye bath as well as more than three dyes into a dye bath and still be within the scope of the invention and provide outstanding dyeing efficacy.

It will be understood that various details of the invention may be changed without departing from the scope of the invention. Furthermore, the foregoing description is for the purpose of illustration only, and not for the purpose of limitation—the invention being defined by the claims.

What is claimed is:

1. A process for dyeing a fibrous article with at least one dye comprising:

(a) immersing said article in a suitably heated liquid bath of a solvent medium for said dye, said liquid bath having a predetermined alkaline pH;

(b) adding acid to said dyeing bath during dyeing to reduce the pH according to a predetermined profile that is responsive to real-time measurements of dyeing bath pH;

(c) adding said dye to said dyeing bath during dyeing as a liquid concentrate in a variable manner that is responsive to real-time calculations of dye uptake by said fibrous article, said adding of said dye occurring independently of said adding of said acid;

(d) determining in real-time during dyeing (1) the solution concentration of said dye in said dyeing bath and (2) the amount of said dye added to said dyeing bath, and calculating the dye uptake by said fibrous article from (1) and (2 );

(e) adjusting the rate of addition of said dye to said dyeing bath during dyeing in accordance with said real-time calculated dye uptake by said fibrous article, wherein said adjustment off the rate of addition of said dye is made according to a predetermined exhaustion profile; and (f) controlling said dye uptake by said fibrous article from said dyebath such that said dye uptake follows said predetermined exhaustion profile, whereby said dyeing of said fibrous article is accomplished.

2. The process of claim 1 wherein said fibrous article is a nylon article.

3. The process of claim 1 wherein said at least one dye comprises two or more acid dyes.

4. The method of claim 3, wherein said two or more dyes comprises at least three dyes.

5. The process of claim 3 further comprising independently adjusting the rate of addition of each of said dyes to the dyeing bath during dyeing in accordance with a predetermined desired ratio of said dyes on said fibrous article during the dyeing process.

6. The process of claim 1 wherein said liquid bath is heated to about 82° C.

7. The process of claim 1 wherein said acid is selected from the group consisting of glacial acetic acid and in acetic acid.

8. The method of claim 1, wherein the predetermined exhaustion profile is further characterized as a profile that profiles for on-tone build-up of shade.

9. The process of claim 1 wherein said dye is added to said dyeing bath by precision dosing with a metering pump.

10. The process of claim 1 wherein said calculating of the dye uptake of said fibrous article and said adjusting of the rate of addition of said dyes during dyeing is controlled by a computer.

11. The process of claim 1 further comprising reusing the exhausted dye bath upon completion of steps (a)–(e).

12. The process according to claim 1 further comprising utilizing prepackaged liquid concentrate dyes for said dyeing process and thereby eliminating use of a conventional dye drug room.

13. A process for dyeing a fibrous article with at least two dyes comprising:

(a) immersing said article in a suitably heated liquid bath of a solvent medium for said dyes, said liquid bath having a predetermined alkaline pH;

(b) adding acid to said dyeing bath during dyeing to reduce the pH according to a predetermined profile that is responsive to real-time measurements of dyeing bath pH;

(c) adding said dyes to said dyeing bath during dyeing as liquid concentrates in a variable manner that is responsive to real-time calculations of dye uptake of each of said dyes by said fibrous article, said adding of said dyes occurring independently of said adding of said acid;

(d) determining in real-time during dyeing (1) the solution concentration of each of said dyes in said dyeing bath and (2) the amount of each of said dyes added to said dyeing bath, and calculating the uptake of each of said dyes by said fibrous article from (1) and (2);

(e) adjusting the rate of addition of said dyes to said dyeing bath during dyeing in accordance with said real-time calculated uptake of said dyes by said fibrous article to maintain a predetermined desired ratio of said dyes on said fibrous article during the dyeing process, wherein said adjustment of the rate of addition of said dye is made according to a predetermined exhaustion profile; and (f) controlling said dye uptake by said fibrous article from said dyebath such that said dye uptake follows said predetermined exhaustion profile, whereby said dyeing of said fibrous article is accomplished.

14. The process of claim 13 wherein said fibrous article is a nylon article.

15. The process of claim 13 wherein said at least two dyes is selected from the group consisting of two dyes and three dyes.

16. The process of claim 15 wherein said dyes consist of acid dyes.

17. The process of claim 15 further comprising independently adjusting the rate of addition of each of said dyes to the dyeing bath during dyeing in accordance with a predetermined desired ratio of said dyes on said fibrous article during the dyeing process.

18. The process of claim 13 wherein said liquid bath is heated to about 82° C.

19. The process of claim 13 wherein said acid is selected from the group consisting of glacial acetic acid and 1N acetic acid.

20. The process of claim 13 wherein said predetermined pH profile comprises maintaining said liquid bath at a predetermined pH of about 8.0 for about fifteen (15) minutes, reducing the pH to about 7.0 in about ten (10) minutes, and further reducing the pH to about 5.0 in about ninety (90) minutes.

21. The process of claim 13 wherein said dyes are added to said dyeing bath by precision dosing with a metering pump.

22. The process of claim 13 wherein said calculating of the dye uptake of said fibrous article and said adjusting of the rate of addition of said dyes during dyeing is controlled by a computer.

23. The process of claim 13 further comprising reusing the exhausted dye bath upon completion of steps (a)–(e).

24. The process according to claim 13 further comprising utilizing prepackaged liquid concentrate dyes for said dyeing process and thereby eliminating use of a conventional dye drug room.

25. A process of dyeing a fibrous nylon article with at least two acid dyes comprising:

(a) immersing said article in a suitably heated liquid bath of a solvent medium for said dyes, said liquid bath having a predetermined alkaline pH of about 8.0;

(b) adding acid to said dyeing bath during dyeing to reduce the pH to about 5.0 according to a predetermined profile that is responsive to real-time measurements of dyeing bath pH;

(c) adding said acid dyes to said dyeing bath during dyeing as liquid concentrates in a variable manner that is responsive to real-time calculations of dye uptake of each of said dyes by said fibrous article, said adding of said dyes occurring independently of said adding of said acid;

(d) determining in real-time during dyeing (1) the solution concentration of each of said dyes in said dyeing bath and (2) the amount of each of said dyes added to said dyeing bath, calculating the uptake of each of said dyes by said fibrous article from (1) and (2), and comparing the ratio of the calculated uptake of said dyes to a desired ratio of said dyes on said fibrous article;

(e) adjusting the rate of addition of said dyes to said dyeing bath during dyeing in accordance with said real-time calculated uptake of said dyes by said fibrous article to maintain a predetermined desired ratio of said dyes on said fibrous article during the dyeing process, wherein said adjustment of the rate of addition of said dye is made according to a predetermined exhaustion profile; and (f) controlling said dye uptake by said fibrous article from said dyebath such that said dye uptake follows said predetermined exhaustion profile, whereby said dyeing of said fibrous article is accomplished.

26. The process of claim 25 wherein said liquid bath is heated to about 82° C.

27. The process of claim 25 further comprising maintaining said liquid bath at a predetermined pH of about 8.0 for about fifteen (15) minutes, reducing the pH to about 7.0 in ten (10) minutes, and further reducing the pH to about 5.0 in an additional ninety (90) minutes.

28. The process of claim 25 wherein said at least two acid dyes is selected from the group consisting of two dyes and three dyes.

29. The process of claim 25 wherein said acid is selected from the group consisting of glacial acetic acid and 1N acetic acid.

30. The process of claim 25 wherein said dyes are added to said dye bath by precision dosing with a metering pump.

31. The process of claim 25 wherein said calculation of the dye uptake of said fibrous article and said adjusting of the rate of addition of said dyes during dyeing is controlled by a computer.

32. The process of claim 25 further comprising reusing the exhausted dye bath upon completion of steps (a)–(e).

33. The process of claim 25 further comprising independently adjusting the rate of addition of each of said at least two dyes to the dyeing bath during dyeing in accordance with a predetermined desired ratio of said at least two dyes on said fibrous article during the dyeing process.

34. The process according to claim 25 further comprising utilizing prepackaged liquid concentrate dyes for said dyeing process and thereby eliminating use of a conventional dye drug room.

35. A process for dyeing a fibrous article with at least one dye comprising:

(a) immersing said article in a suitably heated liquid bath of a solvent medium for said dye, said liquid bath having a predetermined pH;

(b) adding acid to said dyeing bath during dyeing to reduce the pH according to a predetermined profile that is responsive to real-time measurements of dyeing bath pH;

(c) adding said dye to said dyeing bath during dyeing as a liquid concentrate in a variable manner that is responsive to real-time calculations of dye uptake by said fibrous article, said adding of said dye occurring independently of said adding of said acid;

(d) determining in real-time during dyeing (1) the solution concentration of said dye in said dyeing bath and (2) the amount of said dye added to said dyeing bath, and calculating the dye uptake by said fibrous article from (1) and (2);

(e) adjusting the rate of addition of said dye to said dyeing bath during dyeing in accordance with said real-time calculated dye uptake by said fibrous article, wherein said adjustment of the rate of addition of said dye is made according to a predetermined exhaustion profile; and (f) controlling said dye uptake by said fibrous article from said dyebath such that said dye uptake follows said predetermined exhaustion profile, whereby said dyeing of said fibrous article is accomplished.

36. The method of claim 35, wherein the predetermined exhaustion profile is further characterized as a profile that provides for on-tone build-up of shade.

37. The process of claim 35 wherein said liquid bath has a predetermined pH between neutral and slightly acidic.

38. The process of claim 35 wherein said fibrous article is a nylon article.

39. The process of claim 35 wherein said at least one dye comprises two or more dyes.

40. The process of claim 39 wherein said dyes consist of acid dyes.

41. The process of claim 39 further comprising independently adjusting the rate of addition of each of said dyes to the dyeing bath during dyeing in accordance with a predetermined desired ratio of said dyes on said fibrous article during the dyeing process.

42. The process of claim 35 wherein said liquid bath is heated to about 82° C.

43. The process of claim 35 wherein said acid is selected from the group consisting of glacial acetic acid and 1N acetic acid.

44. The process of claim 35 wherein said predetermined pH profile comprises maintaining said liquid bath at a predetermined pH of about 8.0 for about fifteen (15) minutes, reducing the pH to about 7.0 in about ten (10) minutes, and further reducing the pH to about 5.0 in about ninety (90) minutes.

45. The process of claim 35 wherein said dye is added to said dyeing bath by precision dosing with a metering pump.

46. The process of claim 35 wherein said calculating of the dye uptake of said fibrous article and said adjusting of the rate of addition of said dyes during dyeing is controlled by a computer.

47. The process of claim 35 further comprising reusing the exhausted dye bath upon completion of steps (a)–(e).

48. The process according to claim 35 further comprising utilizing prepackaged liquid concentrate dyes for said dyeing process and thereby eliminating use of a conventional dye drug room.

49. The method of claim 39, wherein said two or more dyes comprises at least three dyes.

50. The method of claim 13, wherein the predetermined exhaustion profile is further characterized as a profile that provides for on-tone build-up of shade.

51. The method of claim 25, wherein the predetermined exhaustion profile is further characterized as a profile that provides for on-tone build-up of shade.

* * * * *